US007770628B2

(12) United States Patent
Simpson et al.

(10) Patent No.: US 7,770,628 B2
(45) Date of Patent: Aug. 10, 2010

(54) CONTROL OF CASTING MACHINE

(75) Inventors: John P. Simpson, Naperville, IL (US); Carlton Cash, Westampton, NJ (US); Brian Firtion, Forest, VA (US)

(73) Assignee: Griffin Pipe Products Company, Inc., Downers Grove, IL (US)

( * ) Notice: Subject to any disclaimer, the term of this patent is extended or adjusted under 35 U.S.C. 154(b) by 445 days.

(21) Appl. No.: 11/906,738

(22) Filed: Oct. 4, 2007

(65) Prior Publication Data

US 2009/0090483 A1 Apr. 9, 2009

(51) Int. Cl.
*B22D 13/02* (2006.01)
*B22D 13/12* (2006.01)
*B22D 37/00* (2006.01)

(52) U.S. Cl. ..... 164/457; 164/114

(58) Field of Classification Search ..... 164/114–118, 164/286–301, 335–337, 133–136, 457
See application file for complete search history.

(56) References Cited

U.S. PATENT DOCUMENTS 1,374,750 A * 4/1921 McWane ..... 164/114
3,834,587 A * 9/1974 Bengt et al. ..... 222/595

FOREIGN PATENT DOCUMENTS

JP 46-32341 * 9/1971

* cited by examiner

*Primary Examiner*—Kuang Lin
(74) *Attorney, Agent, or Firm*—Edward J. Brosius

(57) ABSTRACT

Control is provided over the pouring of iron in the casting of iron pipe in a centrifugal casting machine. The initial flow of molten iron from the pouring ladle into the trough actuates an electric eye. A second electric eye is actuated when the molten iron has filled the pouring ladle. The centrifugal casting machine is rolled up to surround the trough, the bell end of the pipe to be formed being at the end of the trough. The molten iron is poured into the casting machine trough and flows into the bell section of the pipe being cast. The casting machine is then moved away from the trough end to form the rest of the pipe.

6 Claims, 1 Drawing Sheet

CONTROL OF CASTING MACHINE

BACKGROUND OF THE INVENTION

The present invention relates to the casting of iron pipe in a centrifugal casting machine. More specifically, this invention relates to the computer control of the process, in which a pouring ladle is automatically filled with an amount of molten iron, from a backup ladle, that is required to cast a particular size pipe.

The centrifugal casting of iron is accomplished by the use of a centrifugal casting machine. The machine comprises a rotating mold that is rollable toward and away from an iron trough which is adapted to be inserted into the rotating mold. Molten iron is poured from a pouring ladle into the iron trough and pours out of the end of the trough into the rotating mold. The end of the pipe first formed is the bell end which has core therein to insure the accurate forming of the bell end of the pipe. However, the core does not extend past the bell end into the length of the pipe. The movement of the casting machine is accomplished by either a hydraulic cylinder, a hydraulic or electrical motor, or a combination of these devices. It is to be understood that in certain casting machines, the casting machine itself remains stationary, and the iron trough is moved away from the casting machine. The principles of the present invention are equally applicable to such an arrangement.

A problem in this centrifugal casting of iron pipe is the supplying of molten iron from the backup ladle to the pouring ladle, with each casting machine each having its own pouring ladle and backup ladle. The amount of the molten iron supplied from the backup ladle into the pouring ladle was manually controlled by an operator. This led to the potential for either too little or to much molten iron entering the pouring ladle and affecting the casting of the iron pipe. Accordingly, it is an object of the present invention to provide a method of automatically controlling the amount of molten iron provided from the backup ladle to the pouring ladle.

It is another object of the present invention to provide a method of automatically controlling the amount of molten iron provided from the backup ladle to the pouring ladle in relation to the size of iron pipe being cast.

SUMMARY OF THE INVENTION

The present invention provides a method for the automated control of the filling of a pouring ladle with molten iron from a backup ladle in the centrifugal casting of iron pipe.

In one embodiment of the present invention, the pouring of molten iron from a backup ladle to a pouring ladle is initiated by an operator. A first photoelectric cell senses such molten iron entering the pouring ladle and provides a first photoelectric cell signal. Upon receipt of the first photoelectric cell signal, the flow of the molten iron from the backup ladle is slowed to fill the pouring ladle at a moderate rate. When the molten iron has filled the pouring ladle, a second photoelectric cell senses such molten iron filling the pouring ladle and provides a second photoelectric cell signal. Such second photoelectric cell signal is processed and provides an appropriate control signal to stop pouring of molten iron from the backup ladle to the pouring ladle.

It can also be part of an embodiment of the present invention to include a completion timer that is started upon receipt of the first photoelectric cell signal indicating that molten metal has begun to enter the pouring ladle. The completion timer sends a timing signal that is utilized to further slow the rate of filling of the pouring ladle. Further, the completion timer can be programmed to send the timing signal based on the amount of molten iron that is required to appropriately fill the pouring ladle for a particular size of pipe being cast.

DESCRIPTION OF THE PREFERRED EMBODIMENT

Figure 1:
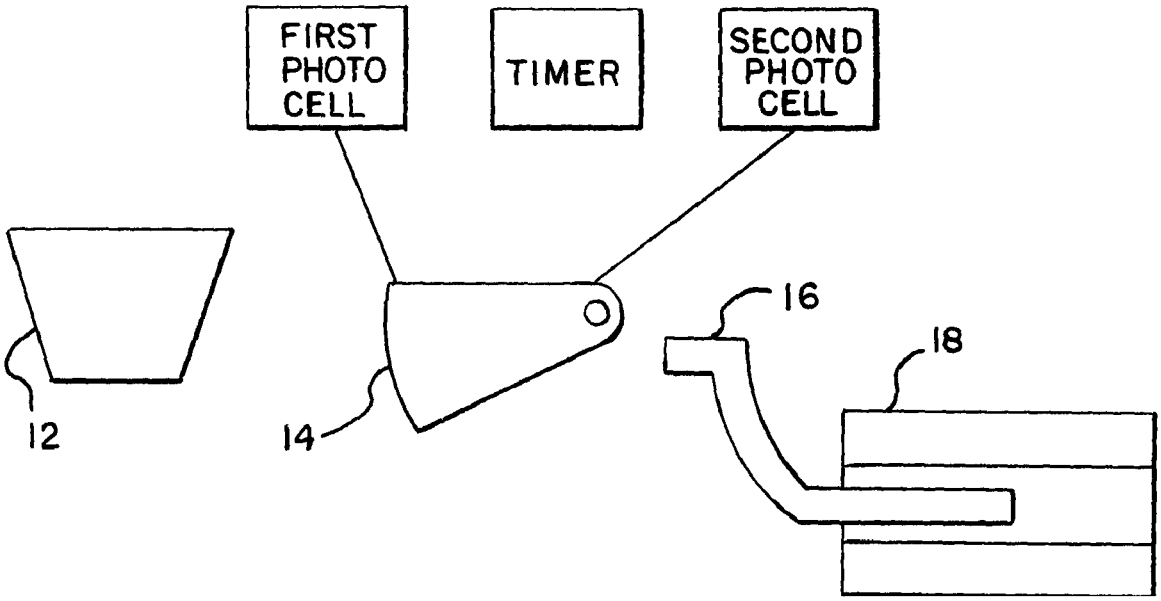
FIG. 1 is the diagramic view of a backup ladle, pouring ladle, a centrifugal casting machine, and associated photo cells and timer in accordance with an embodiment of the present invention.

Referring to FIG. 1, a diagramic view of a control system for regulating the amount of molten iron provided from backup ladle 12 to pouring ladle 14, and ultimately through pouring trough 16 to casting machine 18 is shown.

Backup ladle 12 contains molten iron which is generally provided from a melting system such as a cupola. Typically, enough molten iron is provided to backup ladle 12 to allow the casting of a few iron pipes. Such iron pipes are typically 18 to 20 feet in length, and anywhere from 3 inches in diameter to 48 inches in diameter. The usual term for such cast iron pipe is ductile iron pipe due to the metallurgical treatment of the iron prior to casting.

In a typical process in accordance with the present invention, an operator initiates the pouring of molten iron from the backup ladle 12 to the pouring ladle 14. Once the flow of molten iron from backup ladles 12 enters pouring ladle 14, a first photoelectric cell senses the molten iron entering pouring ladle 14. Such photo cell provides a signal to a processor which in turn controls the flow of molten iron from backup ladle 12 to pouring ladle 14 to a moderate rate.

Pouring ladle 14 is filled with molten iron until a second photoelectric cell senses the iron has reached a preselected fill point within pouring ladle 14. Upon the second photo cell sensing that the molten iron has reached the desired filling level of pouring ladle 14, a signal is sent from the second photo cell to the processor which in turn controls and stops the filling of molten iron from backup ladle 12 into pouring ladle 14.

It is also a part of the present invention that a timer can be activated by receipt of the signal from the first photo cell that molten iron has entered pouring ladle 14. Such timer can be set to further slow the rate of filling of molten iron from backup ladle 12 to pouring ladle 14. Further, the timer can be programmed to prearrange the amount of molten iron that is required to appropriately fill pouring ladle 14 for a particular size of pipe being cast. Accordingly, the timer can send a signal to be processed to cease the flow of molten iron from backup ladle 12 to pouring ladle 14 when the prearranged amount of molten iron required to appropriately fill the pouring ladle for the particular size of pipe being cast has been provided to pouring ladle 14.

The sequence of ladle filling and pouring is as follows: operator initiates the sequence, iron flows as fast rate into the pouring ladle, first photoelectric cell detects iron and signals to slow iron flow to a moderate rate, completion timer times out and signals to slow iron flow to a slow rate, and second photoelectric cell detects iron filled to a desired level in the pouring ladle and signals to stop iron flow.

What is claimed is:

1. A method for controlling the pouring of molten iron for the centrifugal casting of a pipe including the steps of:

initiating the pouring of molten iron from a backup ladle to a pouring ladle, obtaining a first photoelectric cell signal when molten iron passes from the backup ladle to the pouring ladle, obtaining a second photoelectric cell signal when molten iron has filled the pouring ladle, stopping pouring of molten iron from the backup ladle to the pouring ladle upon receipt of the second photoelectric signal, and pouring the molten iron from the pouring ladle into a trough in a centrifugal casting machine, wherein upon receipt of the first photoelectric cell signal, the flow of molten iron from the backup ladle is slowed to fill the pouring ladle at a moderate rate, and wherein a completion timer is started upon receipt of the first photoelectric cell signal, and the completion timer sends a timing signal that is utilized to further slow the rate of filling of the pouring ladle.

2. The method of claim 1 wherein the completion timer can be programmed to send the timing signal based on the amount of molten iron that is required to appropriately fill the pouring ladle for the particular size of pipe being cast.

3. A method of controlling the pouring of molten iron for the centrifugal casting of a pipe including the steps of:

obtaining a first sensing signal when molten iron from a backup ladle begins to enter a pouring ladle, obtaining a second sensing signal when the metal iron has filled the pouring ladle, stopping the pouring of the molten iron into the pouring ladle upon receipt of the second sensing signal, and pouring the molten iron from the pouring ladle into a trough in a centrifugal casting machine, wherein upon receipt of the first sensing signal, the flow of molten iron from the backup ladle is slowed to fill the pouring ladle at a moderate rate, and wherein a completion timer is started upon receipt of the first sensing signal, and the completion timer sends a timing signal that is utilized to further slow the rate of filling of the pouring ladle.

4. The method of claim 3 wherein the completion timer can be programmed to send the timing signal based on the amount of molten iron that is required to appropriately fill the pouring ladle for the particular size of metal pipe being cast.

5. A method of controlling the pouring of molten iron centrifugal casting of pipe, including the steps of:

pouring molten iron from a backup ladle into a pouring ladle, generating a first sensing signal when the molten iron enters the pouring ladle, allowing the molten iron to fill the pouring ladle, generating a second sensing signal when the molten iron has filled the pouring ladle, stopping the pouring of the molten iron into the pouring ladle upon receipt of the second sensing signal, and pouring the molten iron from the pouring ladle into a trough associated with a centrifugal casting machine, wherein upon receipt of the first sensing signal, the flow of molten iron from the backup ladle is slowed to fill the pouring ladle at a moderate rate, and wherein a completion timer is started upon receipt of the first sensing signal, and the completion timer sends a timing signal that is utilized to further slow the rate of filling of the pouring ladle.

6. The method of claim 5 wherein the completion timer can be programmed to send the timing signal based on the amount of molten iron that is required to appropriately fill the pouring ladle for the particular size of metal pipe being cast.

* * * * *